United States Patent [19]

Freelain

[11] Patent Number: 4,682,610

[45] Date of Patent: Jul. 28, 1987

[54] WATER PIPE

[76] Inventor: Kenneth W. Freelain, 1630-A Beekman Pl., NW., Washington, D.C. 20009

[21] Appl. No.: 805,803

[22] Filed: Dec. 6, 1985

[51] Int. Cl.[4] ..... A24F 1/30

[52] U.S. Cl. ..... 131/173; 131/210; 131/187

[58] Field of Search ..... 131/173, 249, 329, 330, 131/200, 210, 187; 128/202.21

[56] References Cited

U.S. PATENT DOCUMENTS 4,161,954 7/1979 Fornaciari ..... 131/173
4,165,753 8/1979 Stryker ..... 131/173
4,201,230 5/1980 Howell, Jr. ..... 131/173
4,215,707 8/1980 Elrich ..... 131/173

*Primary Examiner*—V. Millin
*Assistant Examiner*—H. Macey
*Attorney, Agent, or Firm*—Richard C. Litman

[57] ABSTRACT

A smoking apparatus which efficiently removes harmful impurities from the smoke does so by improving contact between the smoke and a washing liquid. This is accomplished by placing small stones and small floating pieces in a water pipe to increase the distance of the flow path of the smoke through the water, and to decrease the size of the smoke bubbles passing through the water.

9 Claims, 6 Drawing Figures

WATER PIPE

BACKGROUND OF THE INVENTION

For hundreds and possibly thousands of years water pipes known as hookahs or bongs have been used for smoking. The purpose of the water pipe was to purify and cool the smoke so it would be less irritating to the smoker. U.S. Pat. No. 110,594 discloses using a sponge to collect the oil that condenses in the water. U.S. Pat. No. 1,513,147 discloses a second stage filter to further filter the smoke after it passes through the water. U.S. Pat. No. 933,360 discloses baffles is an otherwise conventional pipe stem. U.S. Pat. No. 4,096,868 discloses putting ice cubes in a water pipe to cool the smoke. The water pipe is made from a bottle which opens at the center so that crushed ice does not have to be introduced in the top. The last patent also discloses two permanent mouth pieces attached to the pipe.

None of the above patents provide an effective and efficient means for the liquid in the water pipe to cool and purify the smoke, nor do the above patents provide a means whereby multiple smokers each have their own mouthpiece for insertion into the pipe, except for the last patent discussed which discloses two mouthpieces which are difficult to distinguish from each other. Diseases can be transmitted by multiple smokers using the same mouthpiece. In addition, the components in smoke have been known to cause a large number of health disorders and are suspect in a number of additional health problems.

SUMMARY OF THE INVENTION

The present invention provides a smoking apparatus for effective and efficiently cooling and removing components which are harmful to health from smoke derived from a smokable product.

The apparatus is an open top bottle pipe designed to utilize a liquid in a liquid chamber of the bottle to cool smoke. The bottle is preferably a clear plastic bottle having a heavier colored base such as the throw aways conventionally used as soft drink bottles. Pieces of solid material which are dimensionally stable during use are present in the liquid chamber. Some of the pieces have a density greater than the liquid and some of the pieces have a density less than the liquid. The liquid is predominantly water; so the density of the heavier pieces is greater than one gram per cubic centimeter and the density of the lighter pieces is less than one gram per cubic centimeter. Liquids that can be used include water, wine, water containing aromatic substances such as menthol, water containing volatile medicine and mixtures thereof. The pieces are present in the liquid chamber to create a tortuous path for the smoke to travel through the liquid, create smaller bubbles in the liquid and thus improve contact between the liquid and the smoke thereby aiding in the removal of carcinogens and other materials which are harmful to the smoker from the smoke before the smoke enters the mouth and lungs of the smoker. The pieces having a density greater than the liquid can for example be gravel, rocks, stones, or sand. The pieces having a density less than the liquid can for example be wood or plastic, such as pieces of cork or plastic caps from small non-refillable pens. The pieces are small enough to be inserted into the bottle through the top opening and the neck of the bottle. The pieces have dimensions ranging from one one hundredth of an inch to one inch along either the major or minor axes.

The bottle pipe has one or more, preferably an even number of ports in the side wall of the bottle the diameter of common plastic drinking straws. One or more plastic drinking straws are inserted into the one or more ports in the side wall of the bottle to draw smoke out of the bottle. Each individual user has his own straw. Unused ports are plugged with a rubber or plastic plug.

As is known in the art various materials can be smoked in a water pipe. Unlike the prior art pipes however the pipe of the present invention is convertible and can be equipped with a cigarette holder, a cigar holder, or a pipe bowl. The various holders can be inserted into the top opening of the bottle which is lined with a cylinder.

The pipe bowl is contained inside of a non-combustible cylinder, and comprises a screen insert near the top to form the bowl. the cylinder extends from the top opening of the bottle to a position near the bottom of the liquid chamber.

DETAILED DESCRIPTION

Figure 1:
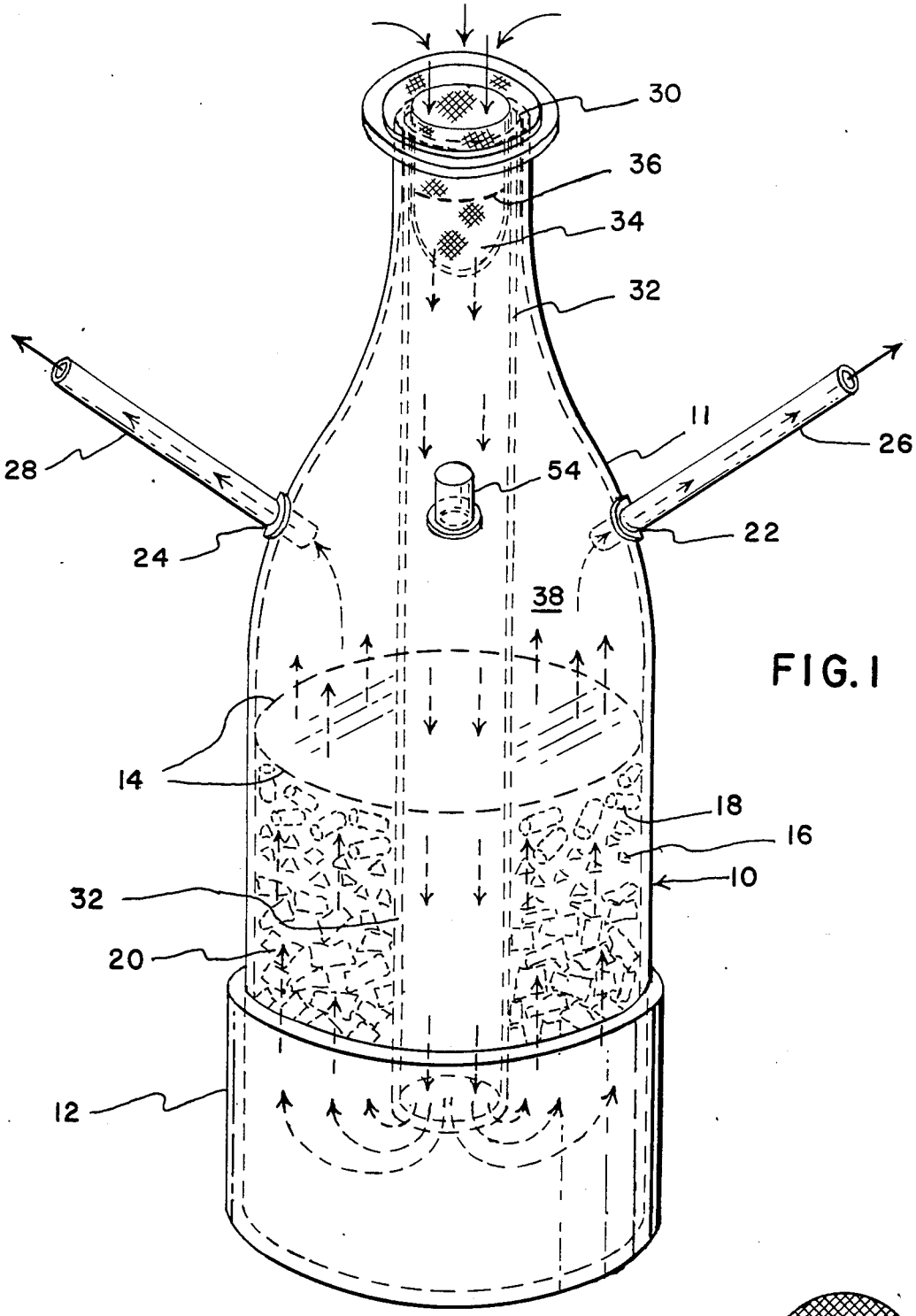
FIG. 1 depicts a front perspective view of the bottle pipe of the present invention.
Figure 6:
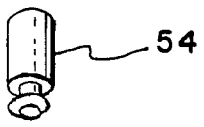
FIG. 6 illustrates a plug used to block unused ports or straws in the bottle pipe.
Figure 3:
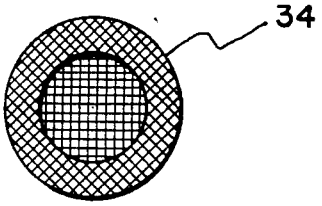
FIG. 3 illustrates a top view of the screen insert which forms the bowl of the pipe of FIG. 1.
Figure 2:
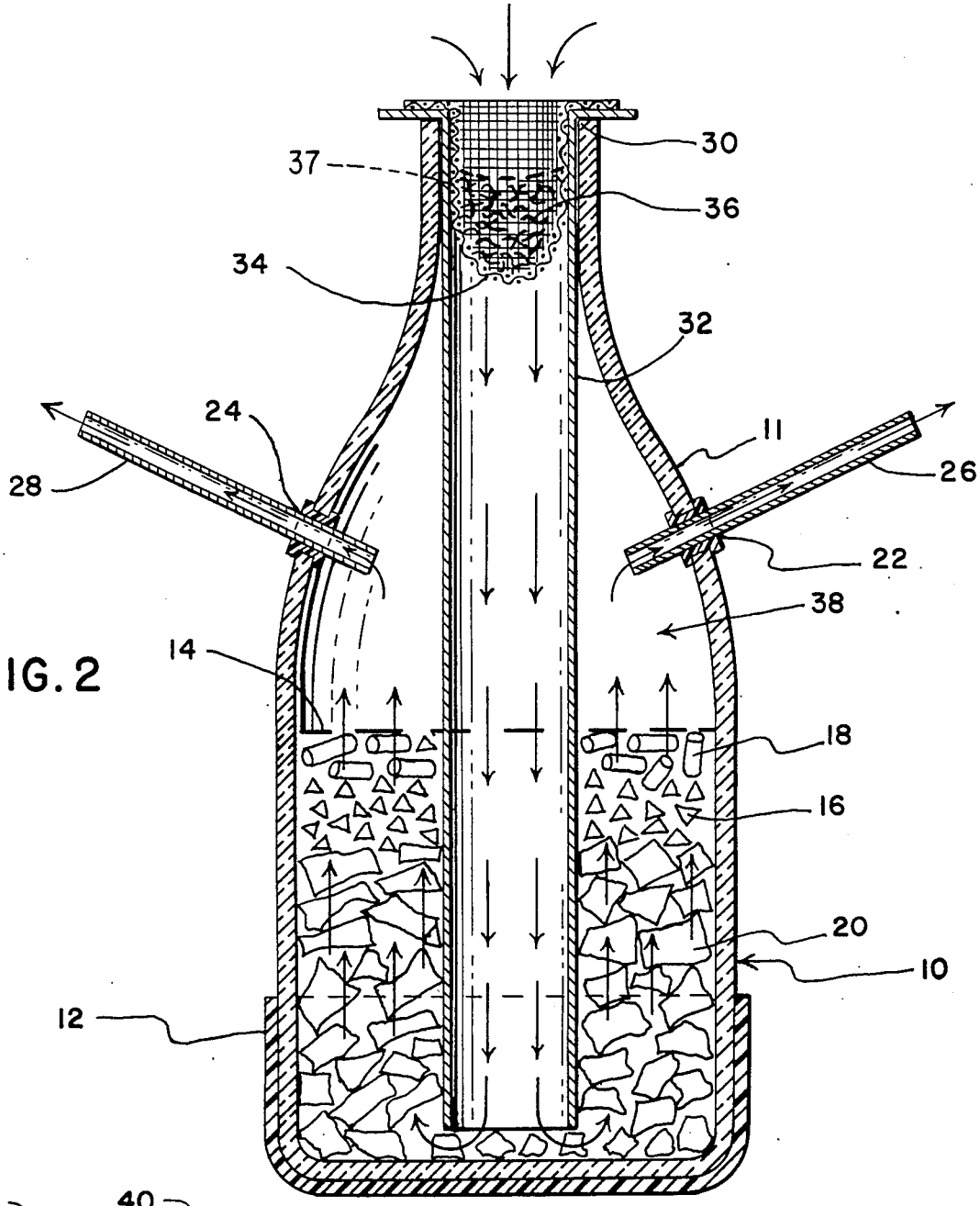
FIG. 2 illustrates a cross sectional view of the bottle pipe of FIG. 1.

With reference to FIG. 1 and FIG. 2, there is shown a transparent bottle 10 having a heavier walled base 12. The bottle 10 is shown partially filled with wine 14. Near the upper surface of wine 14 are pieces having a density less than the density of the liquid or wine 14, the pieces being essentially wood or of cork 16 and plastic pen caps 18. The bottom portion of the bottle 10 contains pieces having a density greater than the density of the liquid or wine 14, the pieces being essentially gravel, stones, sand or rocks 20. In the upper transparent wall 11 of bottle 10 are hole or ports 22 and 24 having the same diameter as plastic straws 26 and 28 which are inserted through ports 22 and 24. Extending from the top opening 30 of bottle 10 to near the inside bottom of bottle 10 is a metal cylinder 32. Inserted in the top of metal cylinder 32 is metal screen 34. In the an upper cavity 37 of the metal screen 34 is placed a smoking material 36 proposed to be smoked.

To smoke the pipe of the bottle 10, the material 36 is lit. Port 24 is held shut with one finger or with plug 54 and smoke is drawn into bottle 10 by suction in straw 26. After the upper cavity 38 fills with smoke a second smoker may draw smoke out by inserting plastic straw 28 into port 24 and drawing on plastic straw 28. Other persons each having their own plastic straws can also draw smoke from the bottle.

The smoke which enters the inside of bottle 10 through the bottom of cylinder 32 is purified by passing first up through the tortuous passageway formed in wine 14 by rocks 20, then the tortuous passageway in wine 14 formed by pieces of cork 16 and pen caps 18.

Figure 4:
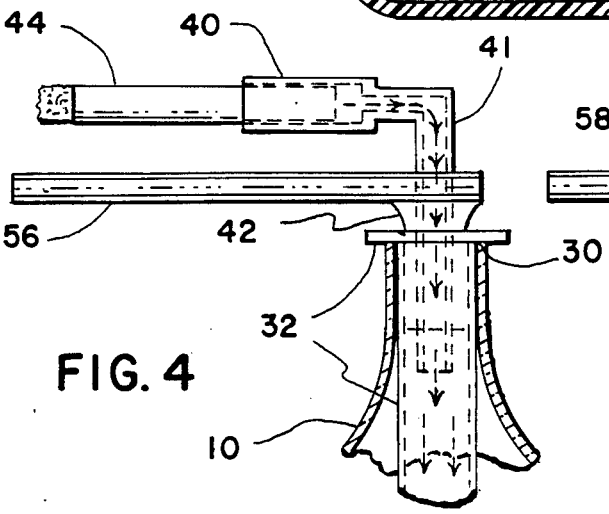
FIG. 4 illustrates a cross sectional view of the bottle neck with a cigarette holder in place.

A cigarette holder 40 is shown in FIG. 4. The cigarette holder 40 is integral with right angle tube 41 which entends into cylinder 32 through cork or resilient plastic seal 42. Cigarette 44 is placed in the holder. In order to use the cigarette holder 40, screen 34 is preferably first removed from the bottle 10. A scoop shaped ash tray 56 is attached to seal 42 or cigarette holder 40 to catch ashes which fall from cigarette 44.

Figure 5:
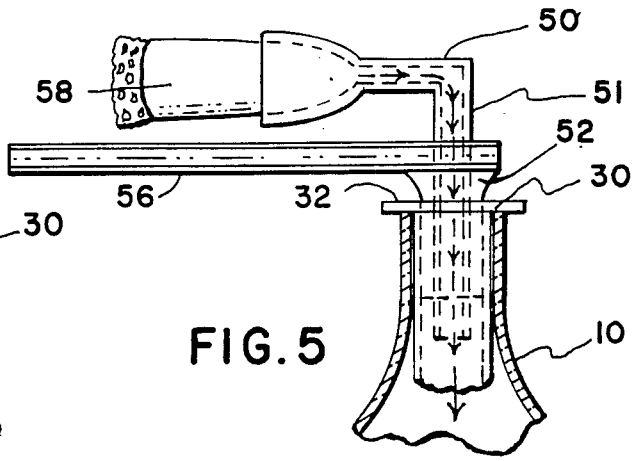
FIG. 5 illustrates a cross sectional view of the bottle neck with a cigar holder in place.

The cigar holder 50 of similar construction is shown in FIG. 5. The cigar holder 50 is integral with right angle tube 51 which extends into cylinder 32 through cork or resilient plastic seal 52. Cigar 58 is placed in the holder.

Various modifications based upon knowledge of the art can be made to the present invention, and are not described in detail here. The modifications however are to be considered within the scope of the present invention. A scoop shaped ash tray 56 is attached to seal 52 or cigar holder 50 to catch ashes which fall from cigar 58.

I claim:

1. A water pipe having an opening in a top of a bottle having a liquid containing a chamber beneath an upper air portion of the bottle for utilizing a liquid in the liquid containing chamber of the bottle to cool smoke from a smoking material, further comprising a metal cylinder extending from the open top of the bottle downwardly beneath a liquid level of the liquid in the liquid containing chamber to near the inside bottom of the bottle, smoke withdrawal means in fluid communication with the upper portion of the bottle for withdrawal of smoke from the bottle, a metal screen disposed within the metal cylinder defining an upper cavity for supporting the smoking material, pieces of solid material disposed within the liquid containing chamber, which pieces are dimensionally stable during use and some of which pieces have a density greater than the liquid and some which pieces have a density less than the liquid, the pieces being present in the liquid containing chamber are so constructed and arranged to create a tortuous path of the smoke drawn through the liquid and thus improve impacting contact between the liquid and the smoke by it being purified thereby aiding in the removal of carcinogens and other materials which may be harmful to the smoker by accomplishing such action upon the smoke before the smoke enters the mouth and lungs of the smoker.

2. The pipe of claim 1 further characterized by the pieces having a density greater than the liquid being selected from the group consisting of gravel, rocks, stones and sand.

3. The pipe of claim 1 further characterized by the pieces having a density less than the liquid being selected from the group consisting of wood and plastic.

4. The pipe of claim 1 further characterized by the pieces being small enough to be inserted into the bottle through the top opening and a neck of the bottle.

5. The pipe of claim 4 further characterized by the pieces having dimensions ranging from one hundredth of an inch (0.2734 cm) to one inch (27.34 cm) along either a major or minor axis.

6. The pipe of claim 1 wherein the smoke withdrawal means comprises one or more ports in a side wall of the bottle, the one or more ports having the diameter of about one-eighth inches (3.4175 cm).

7. The pipe of claim 6 wherein the smoke withdrawal means further comprises one or more plastic drinking straws being provided for insertion into the one or more ports in the side wall of the bottle.

8. The pipe of claim 6 further characterized by having a cigarette or cigar holder inserted into the cylinder from the top opening of the bottle.

9. The pipe of claim 8 further characterized by the water pipe being formed by a non-combustible material.

* * * * *